US006300581B1

(12) United States Patent
Dweck et al.

(10) Patent No.: US 6,300,581 B1
(45) Date of Patent: Oct. 9, 2001

(54) CHRISTMAS TREE TIP SWITCH SAFETY DEVICE

(76) Inventors: Richard Dweck, 70 Farbrook Dr.; Marc Brucker, 10 Dominick Ct., both of Short Hills, NJ (US) 07078

( * ) Notice: Subject to any disclaimer, the term of this patent is extended or adjusted under 35 U.S.C. 154(b) by 0 days.

(21) Appl. No.: 09/507,897

(22) Filed: Feb. 22, 2000

(51) Int. Cl.[7] ..... H01H 35/02; H01H 29/20

(52) U.S. Cl. ..... 200/61.47; 200/61.52; 315/53; 362/806; 439/651

(58) Field of Search ..... 200/61.45 R–61.45 M, 200/220, 223, 226, 233; 315/53; 362/806; 439/105, 502, 503, 651

(56) References Cited

U.S. PATENT DOCUMENTS

| | | | | |
|---|---|---|---|---|
| 1,484,156 | | 2/1924 | Phelan . | |
| 2,763,744 | | 9/1956 | Sternburgh | 200/61 |
| 2,795,768 | | 6/1957 | Duckworth et al. | 339/99 |
| 2,805,296 | * | 9/1957 | Newell | 200/61.47 |
| 3,019,357 | | 1/1962 | Zaffina | 307/157 |
| 3,161,737 | | 12/1964 | Hall | 200/61 |
| 4,830,626 | | 5/1989 | Liu | 439/425 |
| 4,999,544 | | 3/1991 | Cibor | 315/185 |
| 5,150,963 | * | 9/1992 | Hill | 362/123 |
| 5,307,252 | * | 4/1994 | Croup et al. | 362/123 |
| 5,646,383 | | 7/1997 | Deem | 200/52 |
| 5,926,099 | * | 7/1999 | Unum | 340/686.1 |
| 6,037,875 | * | 3/2000 | Moser | 340/686.1 |
| 6,082,867 | * | 7/2000 | Chien | 362/84 |

* cited by examiner

*Primary Examiner*—Michael Friedhofer
(74) *Attorney, Agent, or Firm*—Peter S. Canelias

(57) ABSTRACT

There is provided an electric cord and switch mechanism with receptacles for the insertion of electric plugs and a plug end for insertion into a wall outlet. The cord, receptacle and switch being adapted for attachment to the trunk of a Christmas tree or other member, where a tip switch, such as a mercury switch, is employed in the device to sense departure of the member to which the device is fixed from the normal position with respect to the ground, and interrupting power to the receptacle, thereby interrupting power to any electric device attached to the cord by means of the receptacle.

16 Claims, 2 Drawing Sheets

CHRISTMAS TREE TIP SWITCH SAFETY DEVICE

BACKGROUND OF THE INVENTION

The invention relates to a Christmas tree safety device for indoor use that incorporates a safety tip switch with an electrical receptacle for interrupting power to Christmas tree lights and other electrically powered devices when the Christmas tree is tipped from the normal position relative to the ground. Thus, the device acts as a power cord capable of being tethered to the trunk of a Christmas tree, and acts as a circuit breaker should the tree be tipped or fall, providing a safety mechanism to protect against fire hazard and the danger of electric shock.

The prior art shows tip switches of various types, used in various devices for interrupting power. The prior art also shows various power switching arrangements for electric light bulbs used in connection with decorating Christmas trees. The prior art does not show, however, the use of a tip or tilt switch in conjunction with a Christmas tree or other ornamental plant that carries, inter alia, electric light bulbs and other electrically operated devices.

The dangers of Christmas trees and the like being tipped over by children or pets is well known, and such tipping may result in a fire hazard. This is especially so where light bulbs are broken, and the wires exposed. There is also the hazard of electric shock.

SUMMARY OF THE INVENTION

In accordance with the present invention, there is provided a cord and switch mechanism with receptacles for the insertion of electric plugs and a plug end for insertion into a wall outlet. The cord, receptacle and switch being adapted for attachment to the trunk of a Christmas tree, natural or artificial, where a tip switch is employed in the device to sense departure of the tree from the normal position with respect to the ground, and interrupting power to the receptacle, thereby interrupting power to any electric device attached to the cord by means of the receptacle;

Another object of this invention is to provide an improved safety device which may be attached to the trunk of a Christmas tree or other member in a convenient location;

Another object of this invention is to provide a visual indicium for orienting the device and the tree in the normal position with respect to the ground;

Another object of this invention is to provide a leveling means for orienting the device and the tree in the normal position with respect to the ground.

BRIEF DESCRIPTION OF THE DRAWINGS

The above-mentioned and other features and objects of this invention and the manner of obtaining them will become apparent and the invention itself will be best understood by reference to the following description of an embodiment of the invention taken in conjunction with the accompanying drawings, wherein.

DETAILED DESCRIPTION

Figure 1:
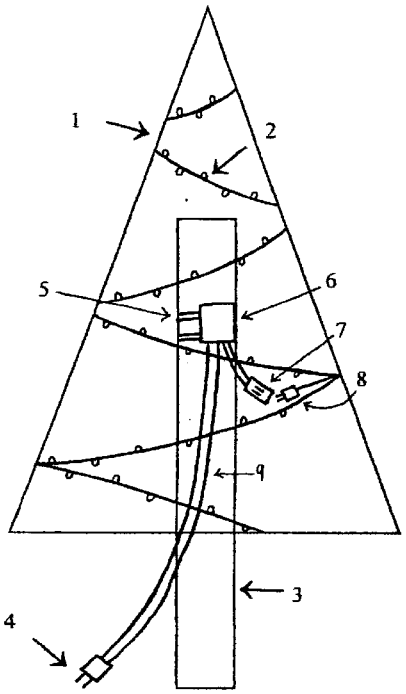
FIG. 1 is a view of a Christmas tree of the fir type with the safety mechanism attached to the trunk of the tree.

Referring now to the drawings, FIG. 1 illustrates a preferred embodiment of the invention. The figure shows a Christmas tree (1) of the fir variety, having the safety device (6) attached to the outer surface of the trunk (3). The straps (5) surround the trunk (3) and secure the safety device (6) thereto. The location of the safety device (6) along the surface of the trunk (3) may be selected by the user for optimal placement and ease of attaching electric devices to the receptacle (7).

The ornamental tree lights (2) are attached to an electric cord which terminates in a male plug member (8). The male plug member of the ornamental tree lights is inserted into the O female plug member (7) which is electrically connected with the main body of the safety device (6). A power cord (9) is electrically connected with the safety device (6) and terminates in a male plug member (4). The male plug member (4) of the power cord may be inserted into a conventional power outlet to supply power to the circuit.

Figure 2:
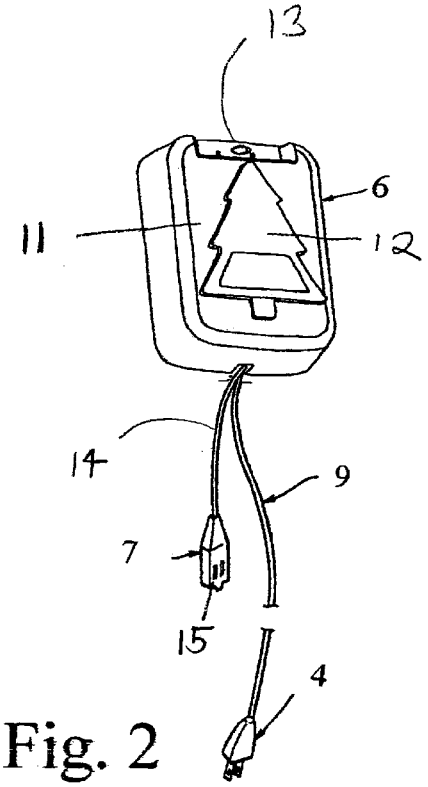
FIG. 2 is a perspective view of a preferred embodiment of the invention.

Turning to FIG. 2, the exterior of a preferred embodiment of the invention is shown. The safety device (6) is enclosed within a housing (11) which is preferably formed from a suitable, colored molded plastic material. The housing (11) has a cable entrance and exit to the plastic housing (11) which allows an incoming power cord and an exiting socket cord to connect with the tip switch mechanism within the housing. The cable entrance and exit are preferably strain relieved to prevent undue strain on the cords, with internal labyrinth strain reliefs. The housing (11) is preferably of two pieces that are fastened together using screws or a snap fit. The dimensions of the housing (11) are about 2 inches by 3 inches by 1.5 inches, and preferably has a nominal wall thickness to meet an Underwriters Laboratory UL 94V-0 flammability rating. The fastening of the two pieces of the housing (11) by means of screws is preferred so that the mercury tip switch (10) is easily removed for hazardous waste disposal. A paper or plastic label may cover the screws holding the housing (11) together. FIG.2 shows a stylized depiction of a Christmas tree (12) on the outer surface of housing (11), which functions as a visual indicator of the positioning and placement of the device. Once attached and oriented along the vertical axis of the tree trunk (3), the Christmas tree depiction (12) also functions as a visual indicator of the orientation of the tree trunk (3), to which it is attached. The Christmas tree shape (12) is particularly adapted to this purpose, forming a base and point which aids the user in determining the normal position with respect to the ground, although other visual indicia may be employed, such as arrows and triangles. In addition, a leveling device (13) may be carried by the housing (11) to aid the user in finding the normal position with respect to the ground. A conventional bubble-type level is preferred for this function, and may be made visible through the use of transparent or translucent plastic in the formation of the exterior of the housing (11) so that the user may visually observe the level indicator when placing the device on the surface of the trunk (3), and subsequently, to adjusting the tree (1) so that it is placed in the normal position with respect to the ground irrespective of any divergence caused by a non-level supporting surface or Christmas tree stand (not shown).

The preferred embodiment has a 6 or 9 foot ungrounded (two-wire) power cord (9) that may be plugged into a standard 115 volt electrical outlet by means of male plug member (4). The power cord (9) is preferably an 18 or 16 AWG UL approved PVC extension cord modified to have a Mercury tip switch (10) attached. The embodiment also has a shorter socket outlet cord, of a preferred maximum length of 12 inches, terminating in female socket outlet (7) that carries individual plug sockets (15). The number of plug sockets may vary, with three or four being preferred. The plug sockets (15) preferably carry non-removable childproof outlet covers to prevent children from being exposed to electric shock hazard.

Figure 3:
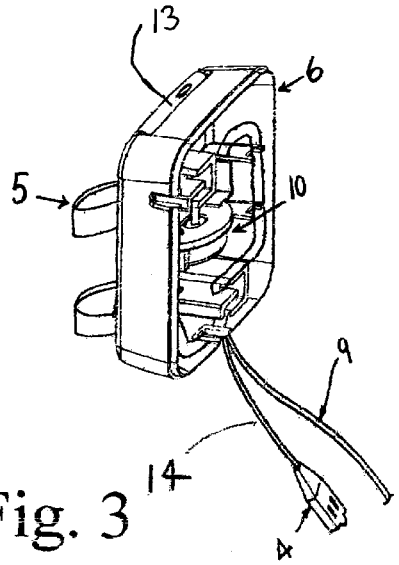
FIG. 3 is a partial sectional view of a preferred embodiment of the invention.
Figure 4:
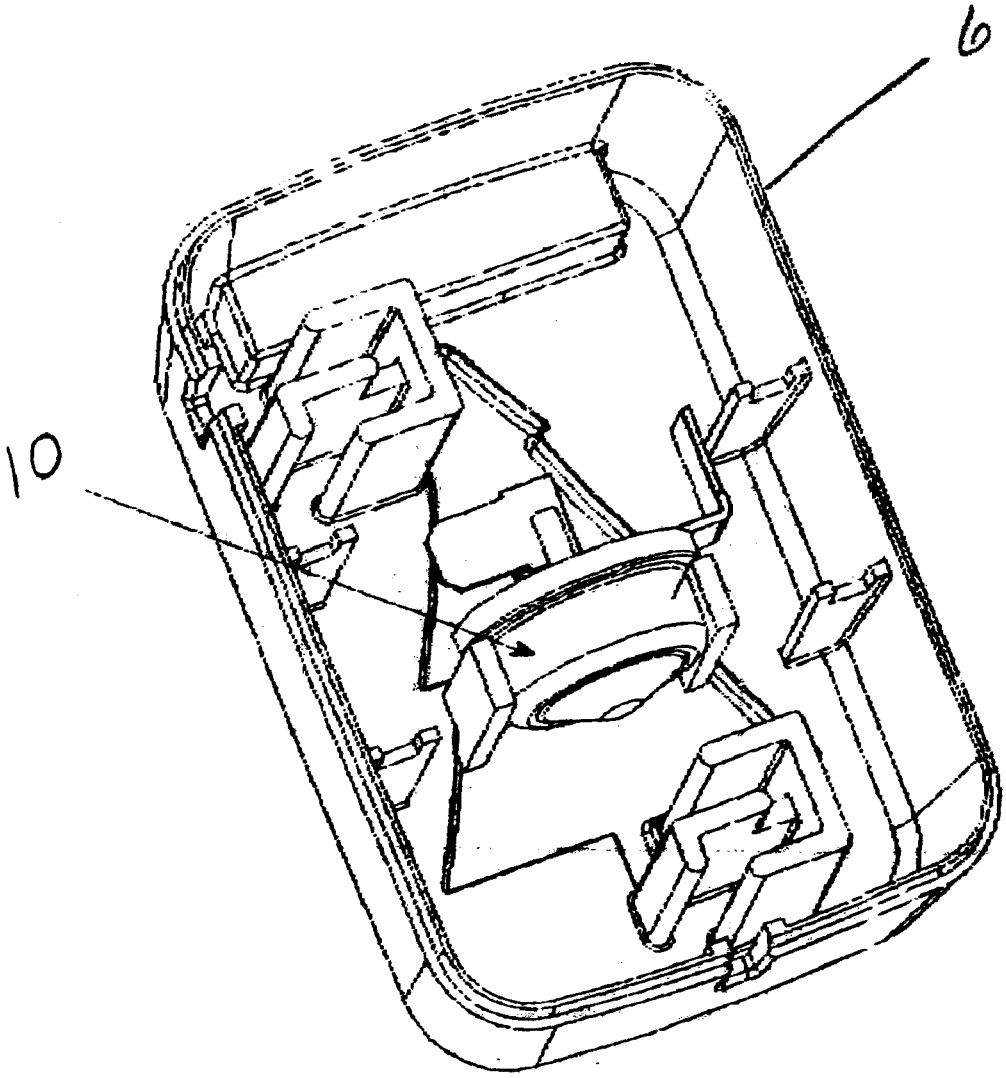
FIG. 4 is rear view of a preferred embodiment of the invention.

Turning to FIG. 3 and FIG. 4, there is shown the safety device (6) with a tip switch (10). The tip switch (10) is preferably a conventional mercury switch of a type commercially available, such as an existing, UL approved device (#E106699). FIG. 3 shows the tip switch (10) is electrically interposed within the circuit so that it may operate as a circuit breaker upon deviation of the housing (11) from the normal position relative to ground. The housing (11) carries means to affix the safety device to a tree trunk, preferably hook and loop style straps (5) such as Velcro® or similar type hook and loop fasteners. Other fastening means may be used, such as tie-wraps, screws, nails or combinations of any of them, depending on the composition of the member to which the safety device (6) is to be fastened.

To operate the safety device, the user first uses straps (5) to affix the device to the outer surface of the trunk (3) (FIG. 1) of a tree at a user-selected location, using the visual indicium (12) to align the device along the trunk (3) so that when the tree (1) is placed in the normal position with respect to the ground, the trunk (3) and the device affixed to the trunk (6) will also be in the normal position with respect to the ground. A leveling device such as a bubble-type level (13) may also be used to adjust the position of the device and of the tree relative to the ground. Once the housing (11) is correctly positioned along the tree trunk (3) and the straps (5) fastened to secure the device in the correct position, the housing may then be further secured to the tree trunk by means of a nail or screw, thus preventing the device from slipping out of the correct orientation with respect to the tree trunk (3). This second attachment means would aid in preventing accidental misalignment of the housing by a child or by a pet, or by failure or slippage of the straps (5).

Christmas tree lights or other electrically powered devices are plugged into the female receptacle (7) as shown in FIG. 2. The user then plugs the male plug (4) into a conventional electric outlet. If the device is in the normal position with respect to the ground, the circuit is closed, and power will flow from the outlet through the device (6) and into the attached Christmas tree light circuit plugged into female receptacle (7). Where the device deviates from the normal position with respect to the ground, the circuit is opened and power interrupted to the devices plugged into female receptacle (7). Where the device (6) is secured to the surface of a tree trunk (3), and the trunk deviates from the normal position through tipping or falling, the switch (10) will interrupt power to the circuit. Thus, continued electric power is dependent on the tree maintaining the normal position with respect to the ground. Interruption of power is also an indicator of a tree that is not secured in the normal position with respect to the ground, such as through a non-level supporting surface or a tree stand, and the device will not allow the power to flow while the tree is in such an initially deviated position.

Since other modifications or changes will be apparent to those skilled in the art, there have been described above the principles of this invention in connection with specific apparatus, it is to be clearly understood that this description is made only by way of example and not as a limitation to the scope of the invention.

What is claimed is:

1. An electric safety device comprising:

an electric cord having a first end and a second end;

a housing disposed within said cord between said first and second ends;

said housing having a switch for interrupting electric power;

means for affixing said housing and switch to a member, so that said housing and said switch are substantially fixed in relation to said member;

said switch being activated to open an electric circuit by a deviation of said housing and said member from a normal position with respect to ground.

2. An electric safety device according to claim 1, where the means for affixing said housing and switch to a member comprises straps.

3. An electric safety device according to claim 1, where said member is a tree trunk.

4. An electric safety device according to claim 1, where said switch is a Mercury switch.

5. An electric safety device according to claim 1, further comprising a visual indicium to indicate an orientation of said housing.

6. An electric safety device according to claim 5, where said visual indicium is in a shape of a fir tree.

7. An electric safety device according to claim 1, further comprising a level indicator to indicate an orientation of said housing with respect to ground.

8. An electric safety device according to claim 7, where said level indicator is a bubble-type level.

9. An electric safety device comprising:

an electric cord having a first end terminating in a male electric plug, and a second end terminating in a female socket;

a housing disposed within said cord between said male electric plug and female socket;

said housing having a switch for interrupting electric power;

means for affixing said housing and switch to a member, so that said housing and said switch are substantially fixed in relation to said member;

said switch being activated to open an electric circuit by a deviation of said housing and said member from a normal position with respect to ground.

10. An electric safety device according to claim 9, where said means for affixing said housing and switch to a member comprise straps.

11. An electric safety device according to claim 9, where said member is a tree trunk.

12. An electric safety device according to claim 9, where said switch is a Mercury switch.

13. An electric safety device according to claim 9, further comprising a visual indicium to indicate an orientation of said housing.

14. An electric safety device according to claim 13, where said visual indicium is in a shape of a fir tree.

15. An electric safety device according to claim 9, further comprising a level indicator to indicate an orientation of said housing with respect to ground.

16. An electric safety device according to claim 15, where said level indicator is a bubble-type level.

* * * * *